United States Patent [19]

Benedict, Jr.

[11] Patent Number: 4,507,716

[45] Date of Patent: Mar. 26, 1985

[54] TOUCH SWITCHABLE LAMP

[75] Inventor: Ralph H. Benedict, Jr., Philadelphia, Pa.

[73] Assignee: Touch-On, Inc., Philadelphia, Pa.

[21] Appl. No.: 482,196

[22] Filed: Apr. 5, 1983

[51] Int. Cl.[3] ..... F21V 23/00

[52] U.S. Cl. ..... 362/295; 362/411; 362/410

[58] Field of Search ..... 362/295, 410, 412, 411, 362/417; 315/362, DIG. 4, 291; 200/DIG. 1, DIG. 2; 307/116, 308; 340/562; 361/179

[56] References Cited

U.S. PATENT DOCUMENTS

| | | | |
|---|---|---|---|
| 2,896,131 | 7/1959 | Schumann | 317/149 |
| 3,255,380 | 6/1966 | Atkins et al. | 315/297 |
| 3,787,732 | 1/1974 | Larson | 307/116 |
| 3,899,713 | 8/1975 | Barkan et al. | 315/34 |
| 4,002,923 | 1/1977 | Larson et al. | 307/116 |
| 4,056,699 | 11/1977 | Jordan | 200/5 |
| 4,090,092 | 5/1978 | Serrano | 307/116 |
| 4,091,610 | 5/1978 | Sasaki et al. | 58/23 |
| 4,101,805 | 7/1978 | Stone | 315/74 |
| 4,123,631 | 10/1978 | Lewis | 200/52 |
| 4,132,903 | 1/1979 | Graham | 307/221 |
| 4,161,766 | 7/1979 | Castleberry et al. | 361/280 |
| 4,211,959 | 7/1980 | Deavenport et al. | 315/362 |
| 4,240,011 | 12/1980 | Dinges et al. | 315/292 |
| 4,247,929 | 1/1981 | Sasaki et al. | 368/69 |
| 4,257,117 | 3/1981 | Besson | 368/69 |
| 4,263,618 | 4/1981 | Wine | 358/188 |
| 4,293,987 | 10/1981 | Gottbreht et al. | 29/54 |
| 4,308,443 | 12/1981 | Tucker et al. | 219/10 |
| 4,360,737 | 11/1982 | Leopold | 307/116 |

*Primary Examiner*—Donald P. Walsh

*Attorney, Agent, or Firm*—John C. Dorfman; Donald R. Piper, Jr.

[57] ABSTRACT

A touch switchable lamp is provided having a base with conductive and non-conductive parts. A conductive coating substantially covers the non-conductive parts of the base and is in electrical contact with at least some of the conductive parts. A switching unit having a touch responsive control terminal is electrically connected with the conductive coating and the conductive parts of the base. A light bulb receptacle is also electrically connected with the switching unit so that whenever a human body is brought into close proximity to the conductive parts or the conductive coating of the base which are electrically connected to the touch responsive control terminal of the switching unit, the switching unit responds by switching the mode of operation of a light bulb between at least a first and second mode of operation.

6 Claims, 1 Drawing Figure

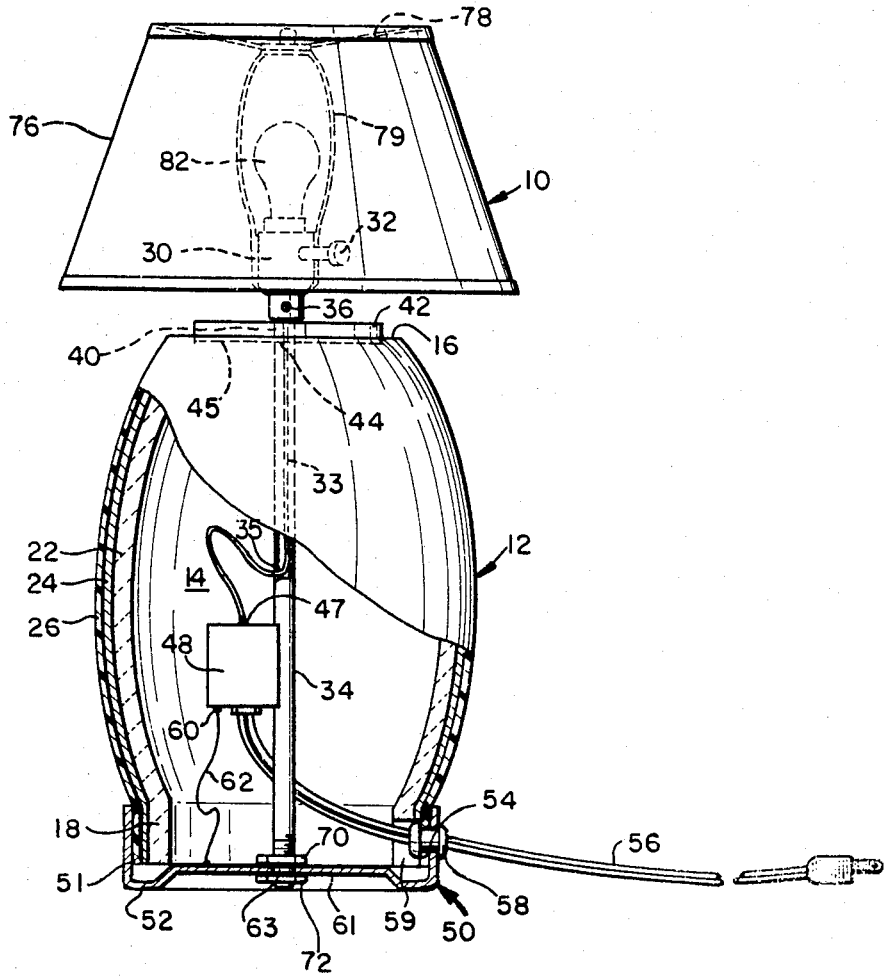
78
76
79
82
10
32
30
36
42
40
16
45
44
33
35
22
12
24
14
47
26
48
34
60
62
54
18
70
56
51
58
52
63
61
59
50
72

TOUCH SWITCHABLE LAMP

FIELD OF THE INVENTION

The present invention relates to a touch switchable lamp which is switchable between at least a first and second mode of operation by the close proximity of a human body part to responsive portions of the lamp.

BACKGROUND OF THE INVENTION

Electric lamps have been developed in which the lamp can be switched to a different mode of operation by touching a selected metallic part or parts of the lamp, such as a light socket or a base ring. In the simplest form, for example, when the selected metallic part of the lamp is touched, the lamp will electronically switch from the "off" mode to the "on" mode and when the selected part is touched again, the lamp will electronically switch back to the "off" mode. However, one of the problems associated with this type of conventional touch switchable lamp is that it is often difficult to locate the selected touch responsive part of the lamp, particularly in the dark. Even after the lamp is located, the user must feel along the lamp until the touch responsive part of the lamp is located.

To eliminate the inconvenience of searching and feeling for a selected touch responsive part of the lamp, it is desirable to provide a lamp which is touch responsive over a more substantial area of the lamp. In accordance with the present invention, a touch switchable lamp is provided which is responsive to the close proximity of a human part to any portion of the lamp base for switching the mode of operation of the lamp between at least a first and second mode of operation. Since a small selected part of the lamp does not have to be located to switch modes of operation, the lamp in the embodying present invention is much more convenient to use especially during the night time hours.

SUMMARY OF THE INVENTION

In accordance with the present invention, a touch switchable lamp is provided. The lamp includes a base having conductive and non-conductive parts with a conductive coating substantially covering the non-conductive parts. The conductive coating of the non-conductive parts is preferably electrically connected with the conductive parts of the lamp base. A light bulb receptacle for a light bulb is supported relative to the base of the lamp and switch means is provided for switching the light bulb between at least a first and second mode of operation. The switch means is supported relative to the base and usually housed within the base, and includes a control terminal connected to the base which responds to touch of the base. Conductive means are provided for electrically connecting the light bulb receptacle in circuit with a power source through the switch means and for connecting the control terminal of the switch means to the conductive parts and the conductive coating of the non-conductive parts of the lamp base. During operation, the close proximity of a human body part to the conductive parts or the conductive coating of the non-conductive parts of the lamp base causes the switch means to switch the light bulb between at least the first and second mode.

BRIEF DESCRIPTION OF THE DRAWINGS

The foregoing summary, as well as the following detailed description of the preferred embodiment of the present invention, will be better understood when read in conjunction with the appended drawing in which:

FIG. 1 is a schematic side view, partially cut away, of a touch switchable lamp embodying the present invention.

DESCRIPTION OF THE PREFERRED EMBODIMENT

Referring to FIG. 1, a touch switchable lamp, generally designated 10, is depicted. The lamp 10 includes a base 12 having a generally hollow interior 14. In this particular embodiment, lamp base 12 includes generally cylindrical but outwardly convex sidewalls 22 which are essentially closed at one end by a wall 16 and which converge at the other end to integrally form a short cylindrical tubular neck portion 18 at an open mouth to provide what might be called a jar shape base 12. As assembled, the jar shaped lamp base is inverted so that the neck portion 18 is disposed at the bottom of the lamp while the end wall 16 of the jar shaped lamp base is disposed toward the upper end of the lamp.

The sidewalls 22 of the lamp base 12 provide an inner support shell of electrically non-conductive material, for example, glass, ceramic, wood or plastic, which provides the rigid support structure of the lamp base. The outer surface of the sidewalls of the jar shaped base is substantially covered by an electrically conductive coating 24. For example, the conductive coating 24 can consist of silver nitrate or some other metallic material. An outer protective and decorative coating 26 is then applied over the conductive coating 24 of lamp base 12. The outer decorative coating 26 is primarily for cosmetic effect so that the lamp base can be colored and/or decorated in a selected fashion. The decorative outer coating 26 also functions to protect and prevent excessive wear of the conductive coating 24 during lamp handling.

The lamp includes a conventional light socket 30 having a switch 32 and conventional insulated conductive lead wires 33 operably connected with the light socket 30. The light socket is mounted at one end of a rigid tubular support rod 34 which is desirably constructed of an electrically conductive material. The lead wires 33 of the light socket are passed through the open end of the tubular support rod when the light socket is mounted on the rod and are passed through the hollow interior of the tubular support rod to an access aperture 35 provided along the tubular sidewall of the support rod. The light socket 30 interfits with and is connected on the end of the tubular support rod by conventional fastener means 36. To facilitate the wiring of the lamp, lead wires 33 must be of sufficient length to permit a predetermined length of the cord to extend from the access aperture 35 of the tubular support rod and out of the mouth of the open bottom of the lamp base at its neck portion 18 so that the lead wires can be connected to a switching unit 48.

The outer end of the rod 34 is inserted and passed through a pair of aligned apertures 40 and 44 through end wall 16 and through the center of a decorative cover 42, respectively. The decorative cover is an inverted circular conductive pan, supported on end wall 16, and is desirably constructed of an electrically conductive material.

The lead wires of cord 33 which extend through the access aperture of the support rod are then connected to appropriate terminals 47 of a switching unit 48. The length of the lead wires 33 extending from the access aperture should be sufficient to permit connection with the switching unit 48 at a position outside of the open mouth of lamp base 12 prior to the insertion of the switching unit into the hollow interior of the base. Lead wires 33 may be an integral part of switching unit 48 enabling the lamp to be wired in a reverse manner in which the lead wires 33 are passed through access aperture 35 and through support rod 34 and then connected with light socket 30.

An electrically conductive base support 50 is provided having a generally shallow cup form with generally tubular sidewalls 51 of a size to snugly engage the external neck portion 18 of the base to close the mouth of the lamp base. The sidewalls 51 function to electrically couple the base support 50 with the conductive coating 24 at the neck portion 18 of the base and to support the inverted jar shaped base in a generally upright position. Since the neck portion is coated by outer decorative coating 26, the sidewalls 51 of the base support do not necessarily contact the conductive coating 24 of the neck portion but are in sufficiently close proximity to be electricaly coupled therewith. The bottom surface 61 of base support 50 is deformed in the middle to leave a peripheral ring support surface 52 upon which the lamp rests. An aperture or slot 54 is provided through the tubular sidewalls 51 of the base support so that a conventional insulated electrically conductive lamp cord 56 having a pair of insulated conductors and a suitable plug for connection to a power outlet can be passed through the sidewall of the base support and connected to the switching unit 48 before assembly while the switching unit 48 is outside of the open mouth of the lamp base 12. The conductors of cord 56 are connected to appropriate terminals of the switching unit 48. A grommet 58 is provided in the aperture 54 to prevent excessive cord wear during use of the lamp. Lamp cord 56 may be an integral part of switching unit 48 so that the lamp cord must be passed outwardly through aperture or slot 54 with grommet 58 having an axial slit along its sidewalls so that the cord 56 can be inserted into grommet 58.

The switching unit 48 includes a touch responsive control terminal 60 which is respondive to touch or to the proximity of a human body part. An insulated electrically conductive lead 62 is connected to terminal 60 and is of sufficient length to permit electrical connection with the electrically conductive base support 50 while the base support is still detached from the lamp base 12 prior to assembly. After the electrical connections are made, the switching unit is inserted into the hollow interior of the lamp base through the mouth and, for example, attached to the exterior of the generally tubular support rod.

Once the switching unit is securely attached to the support rod 34, the base support 50 can be fitted into engagement with the neck portion 18 of the lamp base 12 while the cord 56 is carefully positioned to fall into a slot 59 in the neck. The lamp cord 56 is carefully pulled through grommet 58 to remove the excess cord from the interior of the lamp.

The bottom wall 61 of the base support 50 is recessed leaving a peripheral support ring 52 and a concentric aperture 63 aligned to receive a threaded end of the tubular support rod 34. The support rod 34 is inserted through the apertures 42 and 44 at the top of the lamp and is then passed through the hollow interior of the lamp base and through aperture 63 of the cup shaped base support 51 until the decorative cover 41 is pressed into engagement with the upper surface of the end wall 16 into a position resting upon a support shoulder 45 provided on the end wall. The decorative cover 42 is brought into sufficient proximity with the conductive coating 24 to be electrically coupled therewith even though direct contact is not made between the decorative cover 41 and conductive coating 24 at support shoulder 45. The bottom wall 61 is recessed sufficiently to permit the threaded end of the tubular support rod to pass through aperture 63 and be engaged with suitable retaining means to hold the base support 50 to the base 12 and thereby fix the socket 30 relative thereto without the rod protruding beyond the peripheral ring surface of the base support.

The threaded end of the support rod 34 is provided with a stop nut 70 to limit adjustment of the base support to a selected vertical position of adjustment, preferably allowing snug clamping of the socket and base support against the base 12. The adjustment nut 70 is screwed onto the bottom end of the tubular support rod 34 and adjusted to its selected position prior to the placement of the base support over the neck portion of the lamp base. The base support is then pressed into firm engagement with the neck 18 of the lamp base to effect good electrical coupling between the base support and conductive coating 24 while the bottom threaded portion of the tubular support rod is aligned and inserted through the concentric aperture 63 in the recessed bottom wall 61 of the base support. A retaining nut 72 is then securely fastened to the bottom of the tubular support rod causing the light socket 30 and the decorative cover 42 at one end of the rod to pull against the base support 50 at the other end to securely retain each in its proper position relative to the base 12. The decorative outer coating 26 may be applied over the neck portion of the base because it is not necessary for the electrically conductive base support 51 to actually contact decorative coating 24 to effect the desired electrical coupling therebetween. When this good electrical coupling is established, the whole base is effective for touch or proximity switching instead of merely the metal parts.

A conventional lamp shade 76 having a conventional mounting spider 78 is mounted on a support bracket 79 fixedly attached to the outer housing of the light socket 30. In use, light bulb 82 is provided in the light bulb receptacle 30.

The touch responsive control lead 62 of the switching unit 48 which is connected to the electrically conductive base support 50 is also thereby connected, not only to metal parts connected with the base support, but also with the electrically conductive coating 24 of the lamp base as a result of the good electrical coupling between the conductive coating and the base support. As a result, any accessible part of the lamp base is electrically connected with the touch responsive control terminal 60.

The touch responsive control lead 62 of switching unit 48 can also be connected with the electrically conductive coating 26 of the base in alternative manners which enable any acccessible part of the lamp base to be electrically connected with the touch responsive control terminal. For example, the control lead 62 may be connected to support rod 34 which is, in turn, good electrical contact with light socket 30 and decorative cover 42. With decorative cover 42 being electrically coupled with conductive coating 24, the touch responsive control terminal 60 is thereby electrically connected with all accessible parts of the base. In addition, if lamp shade 76, mounting spider 78 and support bracket 79 are constructed of an electrically conductive material, these parts will also be electrically connected to control terminal 60 and capable of touch switching.

During operation, the switching unit 48 functions to switch the light bulb between at least a first and second mode of operation whenever a human body part is brought into close proximity to any portion of the lamp which is electrically connected with the control terminal 60 of the switching unit. For example, the light bulb may be switched between an "off" mode and an "on" mode or, alternatively, may be switched successively from one intensity level to another over a predetermined range and finally "off".

The switching unit operates by capacitive effect whereby the capacitance of a touch sensitive capacitive network of the switching unit is changed whenever a human body part is brought into close proximity with any conductive portion of the lamp which is electrically connected with the control terminal 60. A change in capacitance is detected by a sensing circuit of the switching unit which causes the control circuitry of the switching unit to switch the light bulb between selected modes of operation. Since the switching unit operates by capacitive effect, it is not necessary to actually touch an electrically conductive portion of the lamp. Consequently, the decorative outer layer 26 which coats the conductive coating 24 of the lamp base will not impede or interfere with the operation of the lamp since it is not necessary to actually touch the conductive coating 24 to switch the mode of operation of the lamp. Merely bring a human body part into close proximity with the conductive coating, such as by touching or almost touching the outer decorative layer, will suffice to switch the mode of operation of the lamp. Switching unit 48 is of conventional design and may be of the type which can be purchased as a commercial unit, such as Part No. 74001 of Southwest Laboratories, Inc. It will be understood, however, that any other type of switching unit which will accomplish the purpose of touch or proximity switching may be substituted.

Finally, while a preferred embodiment of the present invention has been illustrated and described, it is to be understood that certain variations and modifications may be made by persons skilled in the art within the scope of the following claims.

What is claimed is:

1. A lamp touch switchable by human body proximity or contact over the whole base comprising:

(a) a base having non-conductive parts with a conductive coating substantially covering the base over the non-conductive parts;

(b) a light bulb receptacle for a light bulb supported relative to the base;

(c) switch means having a touch responsive control terminal supported relative to the base for switching the mode of operation of the light bulb between at least a first and second mode of operation; and (d) conductive means for electrically connecting the light bulb receptacle in circuit with a power source through the switch means and for connecting the control terminal of the switch means to the conducting coating of the non-conductive parts of the base whereby close proximity of a human body part to the conductive coating of the base will cause the switch means to switch the mode of operation of the light bulb between at least the first and second mode of operation.

2. A touch switchable lamp in accordance with claim 1 comprising a non-conductive coating substantially covering the conductive coating of the non-conductive parts of the base.

3. A touch switchable lamp in accordance with claim 2 wherein said conductive coating comprises silver nitrate.

4. A touch switchable lamp in accordance with claim 1 wherein the non-conductive parts of the base comprise a support shell having a generally hollow interial.

5. A touch switchable lamp in accordance with claim 1 wherein the base comprises a non-conductive support shell having a generally hollow interior and a conductive base support element providing a bottom surface for resting upon a generally planar support surface and generally upstanding side walls for receiving and engaging the support shell to provide electrical circuit continuity with the conductive coating of the shell and for supporting the shell in a generally upright position.

6. A touch switchable lamp in accordance with claim 1 wherein said non-conductive base comprises a support shell having a generally hollow interior with at least one open end and conductive parts comprising a cover for said open end engaging the shell to provide electrical connection with the conductive coating.

* * * * *

UNITED STATES PATENT AND TRADEMARK OFFICE

CERTIFICATE OF CORRECTION

PATENT NO. : 4,507,716

DATED : March 26, 1985

INVENTOR(S) : Ralph H. Benedict, Jr.

It is certified that error appears in the above-identified patent and that said Letters Patent is hereby corrected as shown below:

Colume 3, line 44, "respondive" should be --responsive--.

Claim 4, line 3, "interial" should be --interior--.

Signed and Sealed this

*Ninth* Day of *July 1985*

[SEAL]

*Attest:*

DONALD J. QUIGG

*Attesting Officer* *Acting Commissioner of Patents and Trademarks*